US006006490A

United States Patent [19]

Thibeault

[11] Patent Number: 6,006,490

[45] Date of Patent: Dec. 28, 1999

[54] GLASS TOP FOR BOATS

[76] Inventor: Sylvio Thibeault, 47 Dalhousie, Québec (Qc), Canada, G1K 8S3

[21] Appl. No.: 08/960,456

[22] Filed: Oct. 29, 1997

Related U.S. Application Data

[60] Provisional application No. 60/038,208, Feb. 18, 1997.

[51] Int. Cl.[6] ..... E04B 2/00; B63B 17/00

[52] U.S. Cl. ..... 52/780; 52/781; 114/361

[58] Field of Search ..... 114/357, 361, 114/355, 352, 120, 66, 71; 52/79.1, 86, 780, 781, 481, 762

[56] References Cited

U.S. PATENT DOCUMENTS

| | | | |
|---|---|---|---|
| 2,141,181 | 12/1938 | Geddes | 114/71 |
| 3,898,947 | 8/1975 | Moore | 114/71 |
| 4,587,776 | 5/1986 | Leurent | 52/86 |
| 4,719,871 | 1/1988 | Fantacci | 114/361 |
| 4,979,345 | 12/1990 | Celsi | 52/481 |
| 5,016,558 | 5/1991 | Oehler | 114/357 |

FOREIGN PATENT DOCUMENTS

| | | | |
|---|---|---|---|
| 218071 | 7/1924 | United Kingdom | 114/361 |

*Primary Examiner*—Sherman Basinger
*Assistant Examiner*—Patrick Muldoon

[57] ABSTRACT

A glass top for boats made of a number of arched structural extrusions holding together a series of translucent panels. Some panels, the top ones and the ones on the lower sides, are fixed while the middle ones can slide upward or downward to allow ventilation. Each arched extrusions consists of three superposed extruded members of identical cross-section, held together by bolt assemblies biased by elastomeric strips to enable adjusting the width of the channel receiving the edges of the slidable panels to suit panel of various thicknesses.

8 Claims, 5 Drawing Sheets

GLASS TOP FOR BOATS

CROSS REFERENCE TO RELATED APPLICATIONS

This application claims domestic priority from Provisional Application 60/038,208 filed Jan. 18, 1997.

BACKGROUND: FIELD OF THE INVENTION

This invention belongs to the field of glass tops, especially glass tops to be used on boats.

BACKGROUND—DESCRIPTION OF PRIOR ART

A review of the prior art has revealed the following patents:

U.S. Pat. No. 5,016,558; Oehler May 21st, 1991; shows a retractable roof for passage under low bridges.

U.S. Pat. No. 4,719,871; Fantacci et Al.; Jan. 19, 1988; hull made of a composite having a base of suitably-reinforced plastics. The hull mainly derives from the monohull or unitary-construction hull with several decks.

GB 218,071; Fleming; Jul. 3rd, 1924; improvements on and connected with boats for conveying cargo between a ship and the shore and similar purposes: among improvements is shown a cover extending over an inner hold space: a textile hood may be overlapping.

OBJECTIVES AND ADVANTAGES

A general objective is to provide a glass top light enough to be used on small crafts, the economy of weight being important for performing boats, with sliding panels for the passage of breeze. It must be lighter and thinner than conventional ones to thwart the effect of the sea and the winds must be rounded like an egg shell. A cylindrical like form prevents wind damage and gives pretention against waves and wind in adding locking lugs hold in place the panels to prevent unwanted movement such as release of shell and to ascertain great resistance to wind and water. This glass top is also modular in sections. Some panels are mobile to create openings to let ventilation air go through. An intermediate glass panel moves in two directions towards a roof top area and towards a lower part of a sidewall. When it rains the top is covered and breeze enters by the opened sides. This glass top structure provides a way to adapt to a number of panels of glass, Plexiglas, etc. of various thickness be they opaque or translucent, and permit movement and opening thereof. An objective is to facilitate the interchanging of panels when a boat trip is to be made under certain particular conditions of sun and/or temperature. A more precise objective is to provide a number of arches mounted over a boat deck, each two arches being joined by panels of lexan flexible glass embedded in grooves in the arches. A top panel is to be located in an outward groove, an intermediary panel in a central groove and a low panel in an inward groove. The arches are to be provided with open areas to permit the movement of locking lugs attached to the edges of glass panels.

BRIEF DESCRIPTION OF THE DRAWINGS

An embodiment of the invention will be better explained by referring to the following drawings wherein like numbers refer to like parts and in which.

DESCRIPTION OF THE PREFERRED EMBODIMENTS

Figure 1:
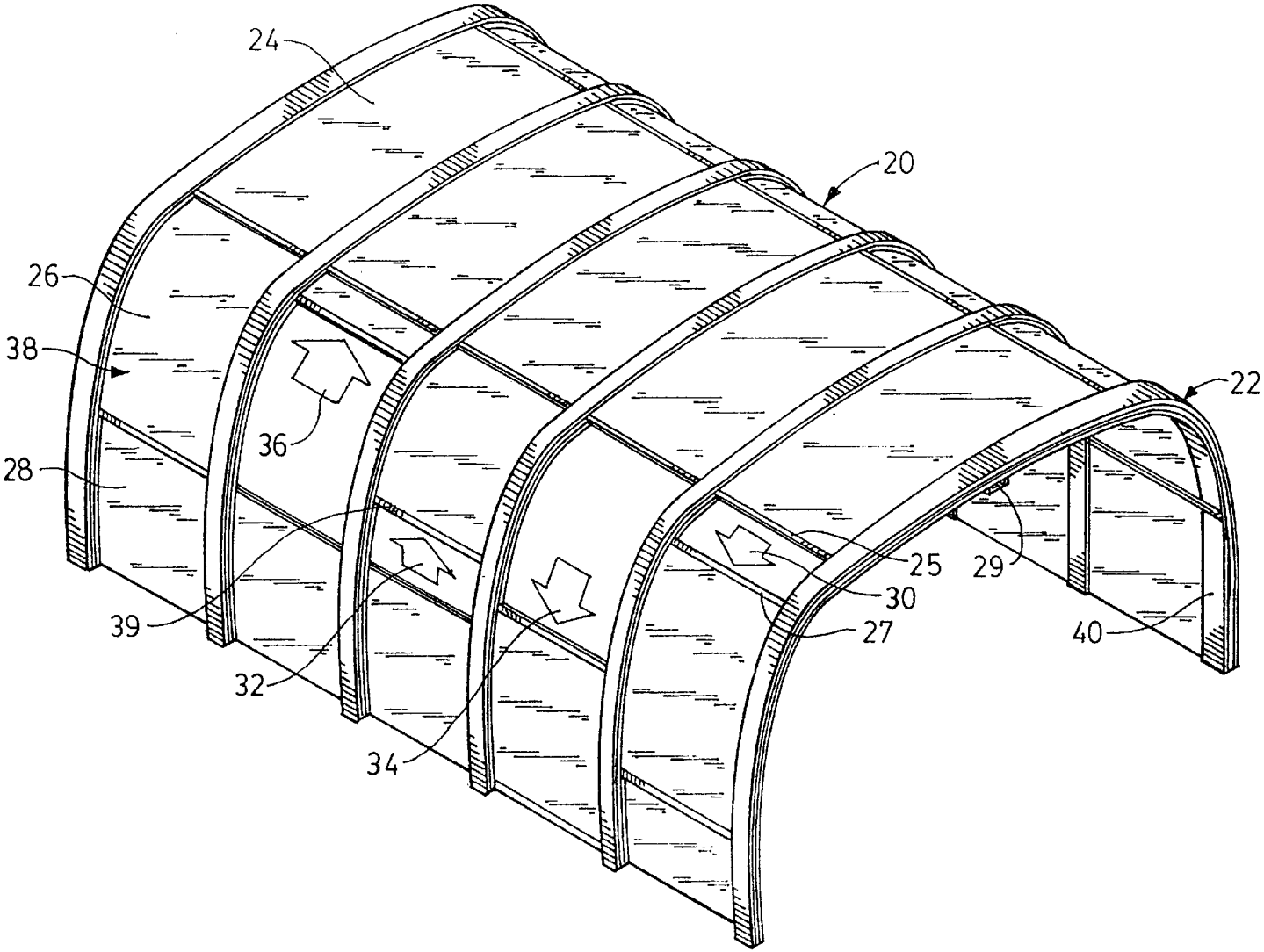
FIG. 1 is a perspective of a glass top

FIG. 1 illustrates a perspective of a transparent glass top 20 for a cruise boat that shows a number of structural extrusions 22 equally spaced. Translucent panels comprise an upper fixed panel 24 with an upper fixed frame 25, a sliding panel 26 with an upper sliding frame 27 and a lower fixed panel 28. A longitudinal beam 29 unites extrusions 22 underneath upper fixed panels 24 and disposed along central axis 23 of glasstop or shelter 20, said axis 23 only shown in FIGS. 2 and 7. Ventilation openings increase when panels 26 are lowered (arrows 30,34) or raised (arrows 32, 36). One sees a closed position 38. The sliding panel 26 is preferably a flexible window panel, made for instance of lexan. Partial of full ventilation is obtained either at the top or bottom of panel 26.

Figure 2:
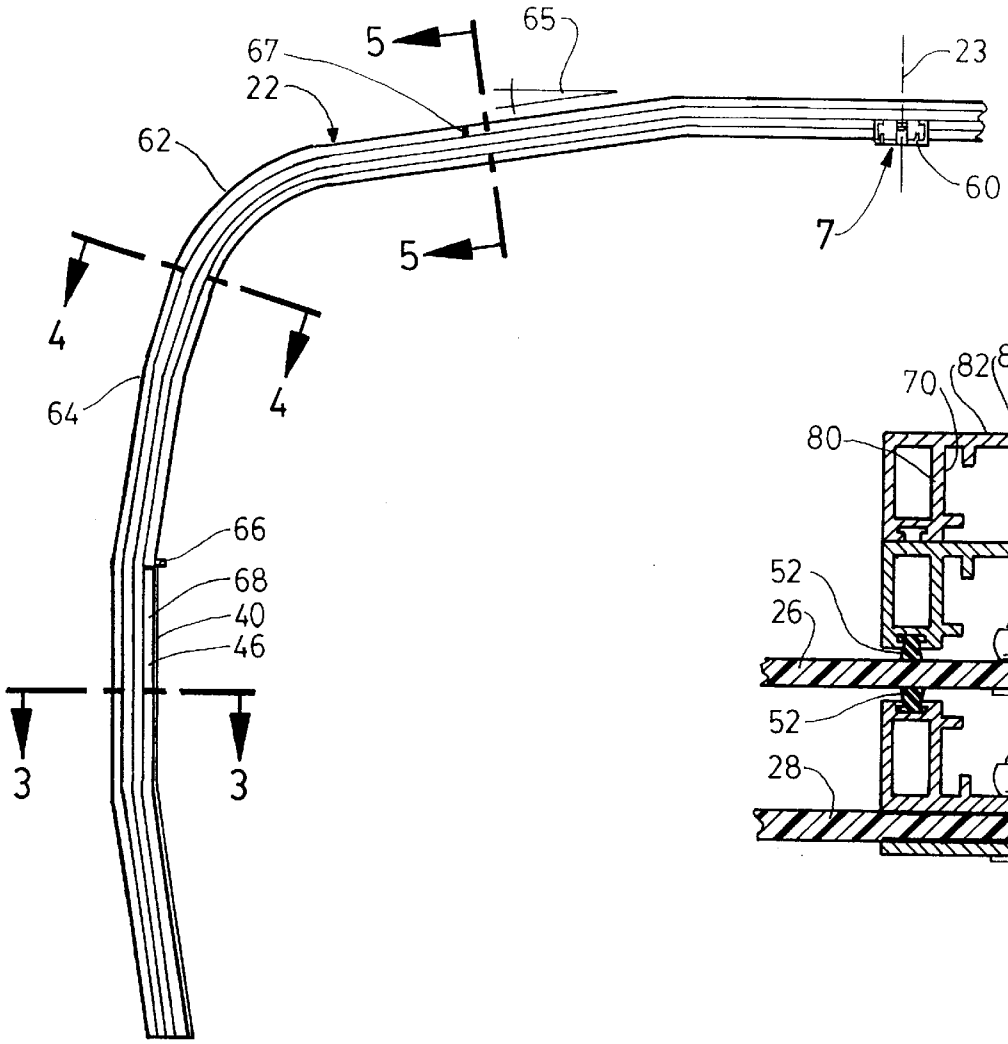
FIG. 2 is an elevation of a structural extrusion of the glass top.

FIG. 2 illustrates an elevation of the structural extrusion 22 and a cross-section of panels 24, 26, 28, panel 26 being closed. One also sees, on the lower fixed panel 28, an aluminum section 66 demarcating the lower fixed panel 28 from the sliding panel 26. Panel 24 overlaps panel 26 and the latter overlaps panel 28; transverse rails 25, 27, and 27, 66 meet in pairs so that the rain is directed on the outside of the panels as shown by arrows 79 in FIG. 8.

Figure 3:
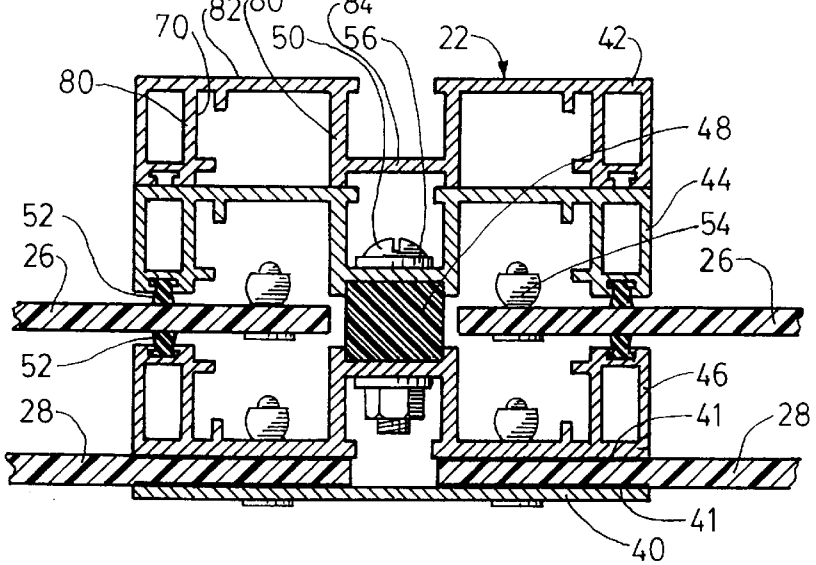
FIG. 3 is a cut according to line 3—3 of FIG. 2.

FIG. 3 shows an inner support strip 40 that holds the lower fixed panels 28 against the inner face of structural extension 22 by means of rivets 55 with the interposition of a sealant 41 such as "polyshim" on both sides of panel 28. The structural extrusion 22 has three by superposed extruded members namely an outer section 42, a central section 44 and inner section 46. Sections 42, 44, 46 have the same cross-sectional shape and an inner section 46 is inverted relative to sections 44, 42. Sections 44 and 46 are spaced by an elastomer 48, such as Teflon, and fixed together by a short assembly screw 50. The elastomer 48, located between the central section 44 and the inner section 46, secures the space necessary to allow the sliding panel 26 to slide easily along a sliding guide 52. An aluminum rivet 54 avoids the removal of the sliding panel 26. Lower rivets 55 and strip 40 hold the lower fixed panels 38 against the inner face of inner section 46. The sliding guide 52 provides a path to the sliding panel 2 and keeps the water away. Assembly screws 50 and elastomer 48 are used to adjust the spacing between section 44 and 46 to fit panels of different thicknesses. A fiber collar 56 surrounds screw 50 to abate the noise caused by the vibrations of the boat.

Figure 4:
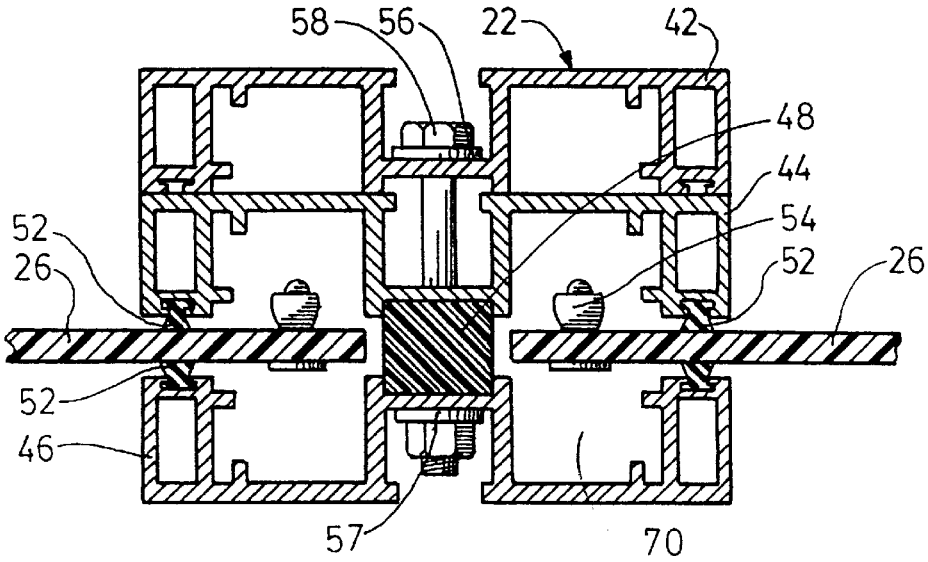
FIG. 4 is a cut according to line 4—4 of FIG. 2.

FIG. 4 shows that sections 42, 44 and 46 are interconnected by long assembly bolts 58 with the interposition of fiber collars 56 and aluminum collars 57.

Figure 5:
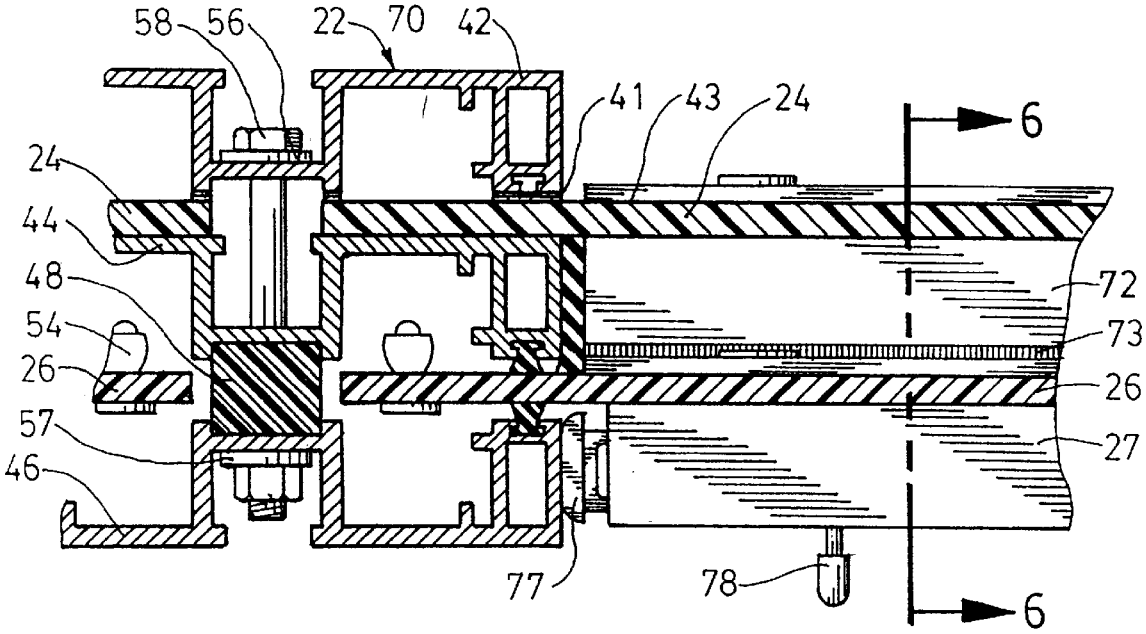
FIG. 5 is a cut according to line 5—5 of FIG. 2.

FIG. 5 shows the upper fixed panel 24 held between the outer section 42 and the central section 44 by the long assembly bolt 58 which also draws the inner section 46. "Polyshim" 41 is placed between extrusions and panels to ensure water-tightness. Holes punched in the structural extrusions 22 allow the engagement of latch gudgeon 77 to open totally, such as in the lower or higher partially or fully open position of slidable panels 26. A latch 78 allows this shift.

Figure 6:
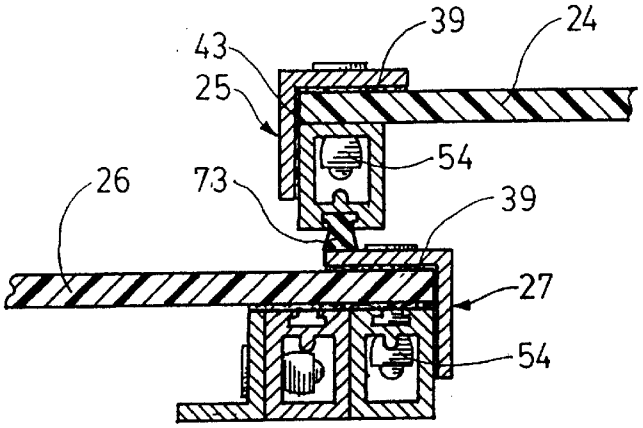
FIG. 6 is a cut according to line 6—6 of FIG. 5.

FIG. 6 shows that slidable panel 26 is in its fully closed position 38, the junction of the upper meeting rail 25 of the fixed panel 24 with the upper melting rail 27 of sliding panel 26 is made watertight by border 73. Each meeting rail is formed by a L-shaped members 39 and tubular members 43 differently assembled by rivets 54.

Figure 7:
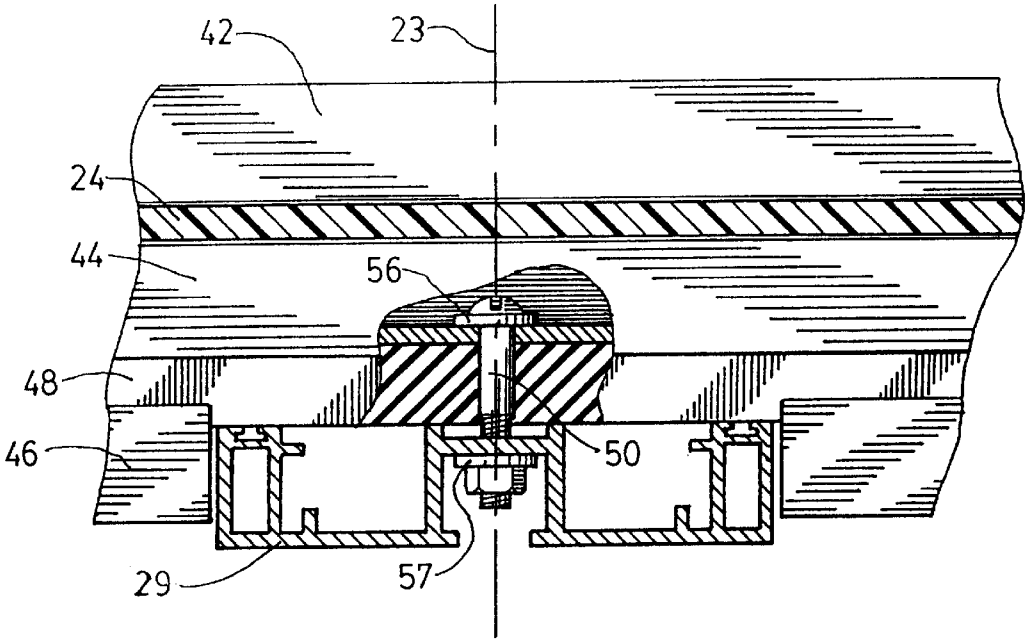
FIG. 7 is a detail in the region of arrow 7 of FIG. 2.

FIG. 7 shows the region of the longitudinal central axis 23. One sees longitudinal beam 29 fixed to the central section 44 by the short assembly screw 50, with the fiber collar 56.

Figure 8:
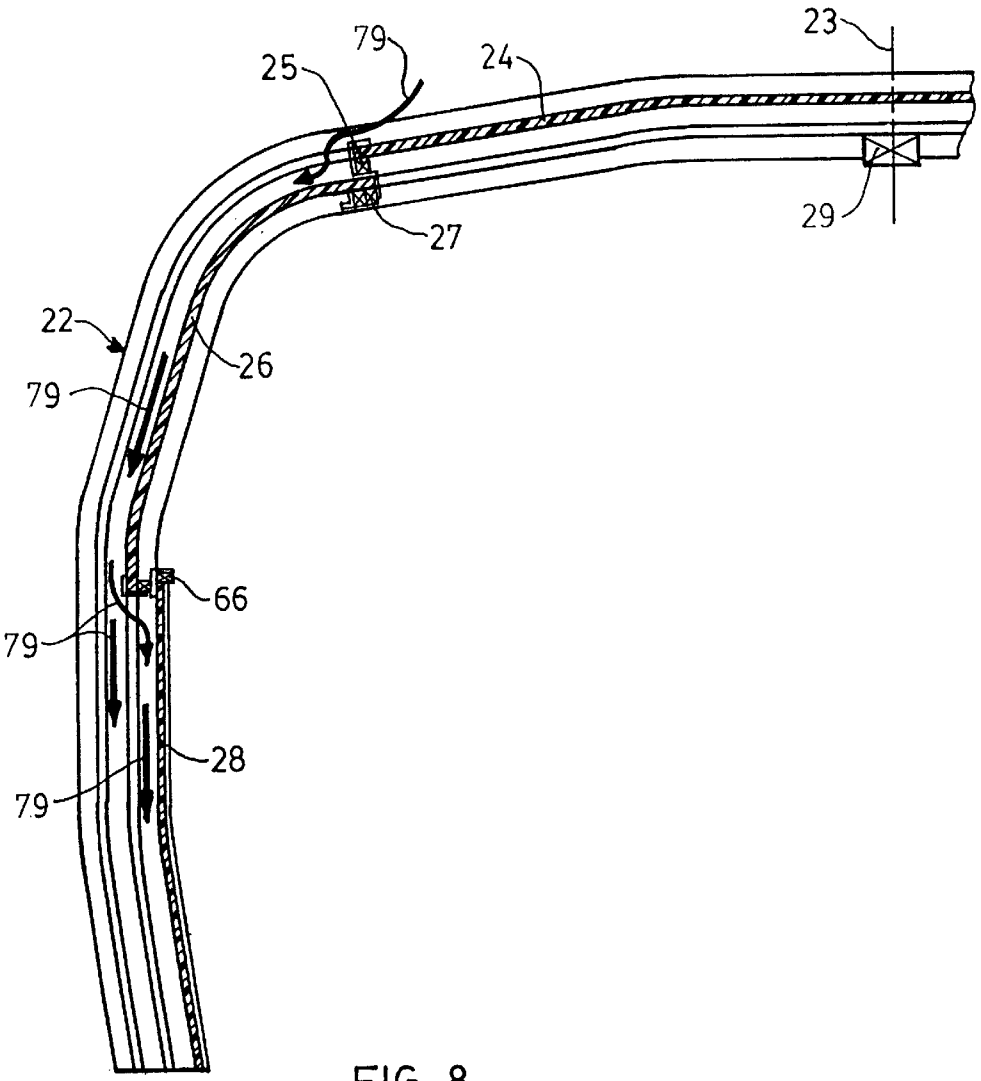
FIG. 8 is an enlargement of FIG. 2 illustrating water flow.

FIG. 8 A section of the glass top 20 comprises three parts; two fixed parts corresponding to the upper fixed panel 24 and the lower fixed panel 28 and a sliding part corresponding to the sliding panel 26. Each of these parts has a corresponding position in the structural extrusion 22.

The effect of rain is illustrated by arrows of water flowing 79 from the upper fixed panel 24 toward the lateral sliding panel 26 and coming down onto the lower fixed panel 38.

It is noted that the three extruded sections 42, 44, 46 and forming each structural extrusion 22 have the same cross-sectional shape. The sliding panel 26 when opened lets air seep in from the top or the bottom and thus permits gravity ventilation. In any condition of temperature one may protect against wind by opening at the top or when it rains one may ventilate by opening near the lower fixed panel 28. The round curve in sliding panel 26 helps prevent vibration. The openings 70 define a cavity in inner section 46 which permits said openings to collect flowing water 79, from which it may be evacuated.

The spacer Teflon 48 may be of any dimension to accomodate the thickness of sliding panel 26.

The material for panels used may be transparent or opaque; it may be of any type as long as the material fits in the channels and has a certain flexibility to contour the curves.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

Other embodiments of the above invention are also possible and limited only by the scope of the following claims:

Parts Lists for Info

20. Glass top
22. Structural extrusion
23. Central axis
24. Upper fixed panel
25. Upper fixed frame
26. Sliding panel
27. Upper sliding frame
28. Lower fixed panel
29. Longitudinal beam
30. Lowering open position
32. Raising open position
34. Lower open position
36. Higher open position
38. Closed position
39. Lexan window
40. Inner support
41. "Polyshim"
42. Outer section
44. Central section
46. Inner section
48. Teflon
50. Short assembly screw
52. Sliding guide
54. Aluminum rivet
55. Lower rivet
56. Fiber collar
57. Aluminum collar
58. Long assembly bolt
60. Oval curve
62. Curvature
65. Slope
66. Aluminum section
67. Fixed superior limit
68. Detachable section
70. Openings
72. Upper fixed frame
73. Watertight section
77. Latch gudgeon
78. Latch
79. Water flowing

I claim:

1. A shelter comprising spaced parallel, arch shaped structural extrusions, each defining a top portion and two leg portions, upper and lower fixed panels extending between and supported by said top portions and by the lower parts of said leg portions respectively and defining shelter openings therebetween, and intermediate flexible slidable panels extending between and slidably supported by said structural extrusions for movement between a closed position closing said openings and either one of an upper opened position under said upper fixed panels and of a lower opened position on the inside of said lower fixed panels, each of said structural extrusions including three superposed extruded members, namely an inner, a central and an outer extruded member, fastener means fastening said inner, central and outer extruded members in superposed position and securing said upper fixed panels sandwiched between said central and outer extruded members, spacer means between and spacing said central and inner extruded members to define channels therebetween in which the edges of said slidable panels are slidably inserted, locking means carried by said edges of said slidable panels to prevent their extraction from said channels and securing means securing said lower fixed panels to said inner extruded members.

2. A shelter as defined in claim 1 wherein said spacer means are elastomeric pieces and said fastener means are bolt assemblies, said pieces and said bolt assemblies enabling to adjust the width of said channels to suit slidable panels of different thicknesses.

3. A shelter as defined in claim 2 wherein said inner central and outer extruded members have the same cross-sectional shape and each includes a pair of U-shaped portions formed by a pair of spaced legs and a bight with a cavity between said legs, and an intervening web spacely interconnecting said U-shaped portions, said bolt assemblies interconnecting the webs of said superposed extruded members and said elastomeric pieces located between the webs of said superposed inner and central and central extruded members, said inner extruded member being inverted relative to said central and outer extruded members.

4. A shelter as defined in claim 3 wherein said upper fixed panels are sandwiched between the bight of said central extruded member and the spaced leg of said outer extruded member.

5. A shelter as defined in claim 4 wherein said lower fixed panels are secured by said securing means flat against said bights of said inverted inner extruded members.

6. A shelter as defined in claim 5 further including sealing guides carried by opposed legs of said central and inner extruded members and slidably engageable with opposite faces of said slidable panels.

7. A shelter defined in claim 6 further including locking lugs secured to the edges of said slidable panels and protruding within said cavities to prevent disengagement of said slidable panels from said channels.

8. A shelter as defined in claim 7 wherein said slidable panels are made of a curved material to prevent vibrations.

* * * * *